United States Patent [19]

Fast

[11] Patent Number: 4,754,563

[45] Date of Patent: Jul. 5, 1988

[54] PRODUCT IDENTIFICATION TAGS

[76] Inventor: Jacob Fast, 7561 NW. 9th St., Plantation, Fla. 33317

[21] Appl. No.: 897,029

[22] Filed: Aug. 15, 1986

Related U.S. Application Data

[63] Continuation-in-part of Ser. No. 719,116, Apr. 2, 1985, abandoned, which is a continuation-in-part of Ser. No. 519,226, Aug. 2, 1983, Pat. No. 4,525,944, which is a continuation-in-part of Ser. No. 473,650, Mar. 9, 1983, Pat. No. 4,531,313.

[51] Int. Cl.[4] ..... G09F 3/08

[52] U.S. Cl. ..... 40/663; 40/124.1; 40/657

[58] Field of Search ..... 40/10 R, 19.5, 20, 308, 40/324, 584

[56] References Cited

U.S. PATENT DOCUMENTS

| | | | |
|---|---|---|---|
| 1,005,894 | 4/1911 | Senseman | 40/10 X |
| 1,157,195 | 10/1915 | Ulrich | 40/2 X |
| 1,866,554 | 6/1932 | Fairbanks | 40/2 X |
| 2,199,968 | 4/1940 | Flood | 40/2 R |
| 2,305,426 | 11/1942 | Howell | 40/10 X |
| 2,564,293 | 8/1951 | Ammon | 40/10 X |
| 3,539,204 | 11/1970 | Keller | 40/308 |
| 3,706,150 | 12/1972 | Greenberger | 40/16 |
| 3,977,109 | 8/1976 | Berry, Jr. et al. | 40/10 |
| 4,351,440 | 9/1982 | Thalendfeld | 40/16 |
| 4,405,051 | 9/1983 | Thalenfeld | 40/19.5 |
| 4,463,510 | 8/1984 | Windish | 40/19.5 |
| 4,583,308 | 4/1986 | Taub | 40/617 |
| 4,646,454 | 7/1985 | Fast | 40/324 |

FOREIGN PATENT DOCUMENTS 884536 4/1961 United Kingdom .

*Primary Examiner*—Gene Mancene
*Assistant Examiner*—Wenceslao J. Contreras
*Attorney, Agent, or Firm*—Holman & Stern

[57] ABSTRACT

Several embodiments of a product identification and display tag for use in connection with a product-suspending hook extending substantially horizontally from a support surface are disclosed. In each case the tag comprises first and second parts. The first part has a mounting portion for attachment to the hook adjacent the support surface, and an elongate portion extending from the mounting portion for overlying the hook. The second part of the tag comprises a display portion for hanging vertically at the forward end of the hook to receive a product information and identification label or the like. The second part of the tag is releasably attached to the first part by male and female connector elements so that when a label is to be replaced, the second part of the tag can be removed and replaced with another second part having a new label, thereby avoiding the need to replace the tag as a whole.

12 Claims, 4 Drawing Sheets

PRODUCT IDENTIFICATION TAGS

CROSS REFERENCE TO RELATED APPLICATIONS

This application is a continuation-in-part of application Ser. No. 06/719,116, filed Apr. 2, 1985 for "Improvements Relating to Product Identification Tags", which is itself a continuation-in-part of application Ser. No. 06/519,226, filed Aug. 2, 1983 for "Improved Product Identification Tag" itself a continuation-in-part of application Ser. No. 06/473,650, filed Mar. 9, 1983 for "Merchandise Information Tag With Improved Mounting Arrangement". The disclosures of all the above applications are expressly incorporated herein by reference.

BACKGROUND OF THE INVENTION

The invention relates to product identification and information tags for merchandise suspended from elongate horizontally oriented support hooks and the like. More particularly, the invention relates to such tags which may be readily attached to and removed from the support hooks without being subject to inadvertent removal, and which display product information forwardly of merchandise supported on a hook.

My prior applications Ser. Nos. 519,226 and 473,650 noted above disclose, inter alia, elongate product information and identification tags made of plastic sheet which display the product information forwardly of items suspended from horizontal hooks, which may extend, for example, from an apertured support board or the like. The tags include a mounting portion for attachment to and removal from the hook at a location adjacent the board, an intermediate portion extending forwardly from the mounting portion over the length of the hook and the merchandise suspended therefrom, and a display portion integrally formed at the distal end of the intermediate portion and which is bent downwardly in front of the hook for the display of required product identification and/or information data. Further, the tags disclosed in application Ser. No. 06/519,226 have an aperture adjacent the distal end of the intermediate portion for an end portion of the hook to project upwardly through, thereby providing lateral stabilization of the tag. When a product is removed from the hook over the front end, the tag flexes upwardly to free the end of the hook and the tag drops back over the end of the hook after the product has been removed.

Product identification and/or information data is commonly provided on an adhesive label which is applied to the display portion of the tag. If any of the information data, for example the product price, is to be changed, it is necessary either to remove the label, which may be difficult or impossible, or to stick a new label over the old one. In certain jurisdictions, however, this is illegal, so that the entire tag then has to be removed and replaced resulting in wastage of tags. Also, even where not illegal, the procedure may be subject to abuse by removal of the topmost label. Another problem which may arise, is that labels, if improperly applied, or labels having poor adhesive, may tend to become separated from the tag.

Accordingly, the present invention provides identification tag structures intended to mitigate the above problems.

SUMMARY OF THE INVENTION

In accordance with the present invention a product identification or information tag generally of the kind disclosed in either one of the above noted prior patent applications Ser. Nos. 519,226 and 473,650 is provided with a separate display portion for releasable attachment to and detachment from the distal or forward end of the intermediate portion of the tag.

In one form of the invention, for example, the display portion may comprise a plain sheet of plastic with at least one headed spear-like element on one edge and a fold line extending completely across the element adjacent said edge, the or each spear-like element releasably engaging into a corresponding transverse slit at the forward end of the intermediate portion of the tag, and the display portion being folded downwardly about the fold line. This form of display portion is intended primarily for use with adhesive type information and/or identification labels, so that when a new label is required, the display portion can simply be detached from the body of the tag and replaced by another one with the new label, rather than having to replace the entire tag.

In another form of the invention, the display portion is again formed from a plastic sheet with a spear-like projection or projections on one edge for engaging in a slit or slits in the intermediate portion of the tag, and with a fold line as aforesaid, but in this case the sheet is extended and folded to form a pocket or envelope to receive a non-adhesive product information and/or identification label.

With display portions, however, that have one or more spear-like or similar headed elements which fit releasably in a slit at the end of the elongate portion of the tag, it is found that in use with continual lifting and lowering of the tag as a whole, to remove merchandise from the support hook, when the display portion is used to lift and lower the tag, the display portion may tend to flap upwardly relative to the elongate portion of the tag with eventual loosening, weakening or even fracture of the headed element. Accordingly, in a third form of the invention, the display portion is provided on one edge with a tongue element which fits in the slit of the elongate portion in like manner to the headed elements of the previous embodiments, and further with an extension adjacent the tongue element which engages an upper surface of the elongate portion of the tag when the tongue element is engaged in the slit in order to form a stop which precludes upward flapping of the display portion relative to the elongate portion of the tag thereby substantially stabilizing the assembly.

In yet another embodiment of the invention, a tag structure as previously described may be provided with an additional oversized detachable display portion for use over an existing display portion, the oversize display portion including a substantially heart-shaped headed element adapted to be flexed into engagement in the elongate slot at the forward end of the elongate portion of the tag, through which the forward end of the support hook projects, so as to detachably secure the oversize display portion to the tag. The oversize portion may, for example, be used when temporary product information, such as a sale price, is to be displayed after which the oversize portion can be removed to expose the original display portion.

In any form of the invention, a tag body may be provided with selectively usable display portions of different widths and/or heights, to suit different size labels.

Additional features and advantages of the invention will become apparent from the following description and claims read in conjunction with the attached drawings.

DESCRIPTION OF PREFERRED EMBODIMENTS

Figure 1:
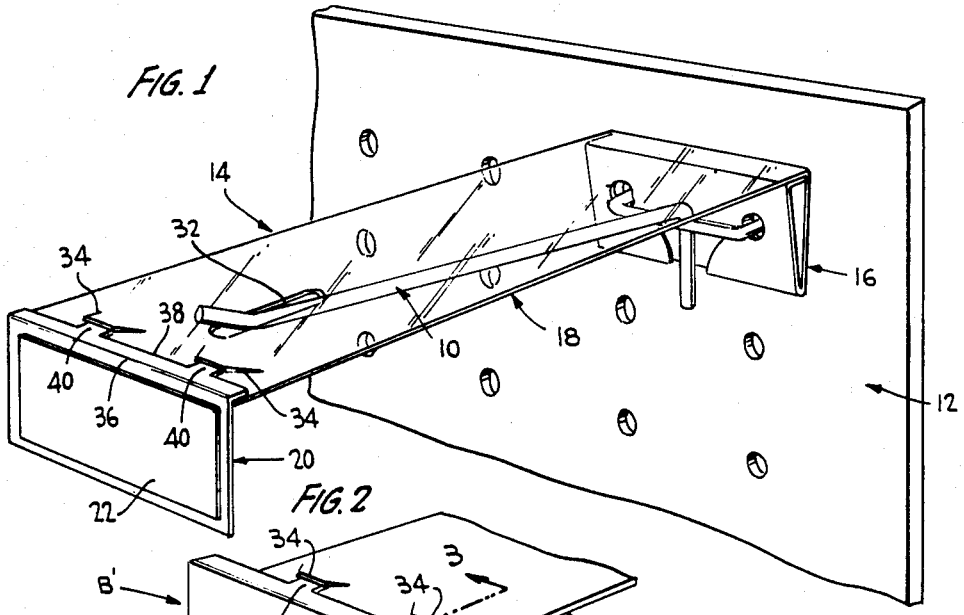
FIG. 1 is a perspective view of a product information and identification tag structure in accordance with the invention shown in combination with an elongate product-suspension hook.

Referring initially to FIG. 1, there is shown an elongate support hook 10 of a known type which extends substantially horizontally from an apertured board 12 for the display of a row of products suspended from the hook. The hook may have prongs (not shown) at its proximal end engaging in the board apertures to retain the hook in place. Further, a product identification and information tag 14 in accordance with the invention is provided to extend over the hook and provide identification and/or information data pertaining to products supported on the hook, such data being displayed at a location forwardly of the products.

Figure 4:
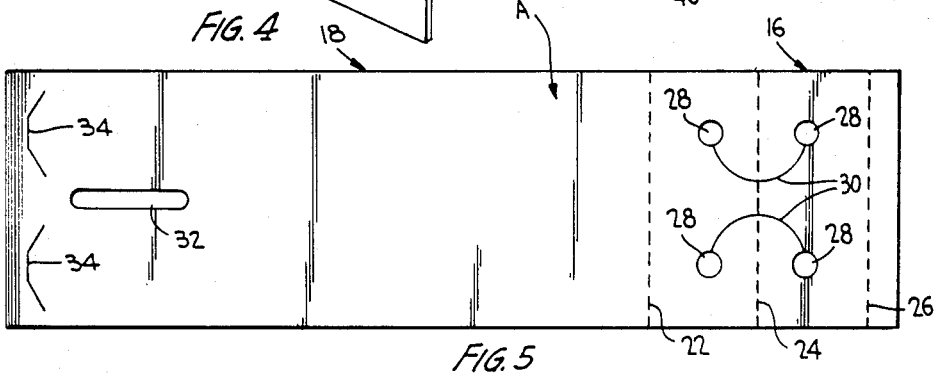
FIG. 4 is a plan view of a blank from which the body portion of the tag structure shown in FIG. 1 is formed.
Figure 5:
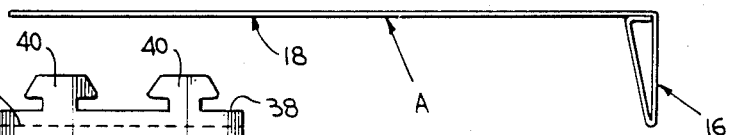
FIG. 5 is a side elevational view of the blank folded to form the body portion of the tag.

Tag 14 which is formed of plastic sheet has a mounting portion 16 at its rearward end for gripping onto the hook 10 at a location adjacent board 12, an elongate intermediate portion 18 extending from the mounting portion over the length of hook 10, and a display portion 20 at its forward or distal end beyond the end of the hook, which is bent down to receive an adhesive label 22, for example, inscribed with the product data. The construction of the tag is further illustrated in FIGS. 4 through 6 where it will be clearly seen that the tag as a whole is formed from two separate parts or blanks namely a first part A defining the mounting portion 16 and the intermediate portion 18, and a second detachable part or blank B defining the display portion 20.

Mounting portion 16 is formed by folding part A of the tag about bend lines 22, 24, 26 whih are scored across part A in its manufacture. Further, the mounting portion is formed with die-cut holes 28 and connecting slits 30 whereby the mounting portion is clipped onto the back of the hook. A fuller description of this form of mounting portion is given in application Ser. No. 519,226, and it should here be noted that this particular mounting portion is shown herein by way of example only. Tags in accordance with the present invention can have different forms of mounting portion, for example to suit different types of hooks, and the present invention is primarily concerned with the construction of the forward or distal end of the tag.

As also described in detail in application Ser. No. 519,226, intermediate portion 18 of part A of the tag may be formed with an alongate die-cut aperture 32 for receiving the distal end of hook 10 and stabilizing the tag laterally. Forwardly of aperture 32, the intermediate portion of the tag is provided with a pair of three-part die-cut slits 34 adjacent its forward edge for the releasable attachment of part B of the tag in a manner to be described.

Figure 6:
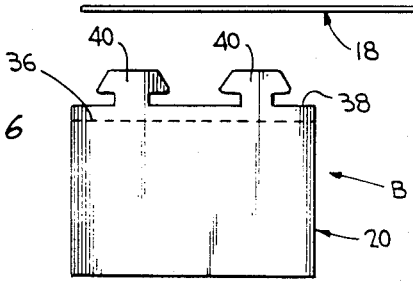
FIG. 6 is a plan view of a blank forming a display portion of the tag.

Part B of the tag, see particularly FIG. 6, comprises the aforementioned display portion 20 which terminates in bend line 36 scored across the entire width of part B adjacent its upper edge 38, and a pair of headed spear-like projections 40 on the upper edge. The projections each have a profile which is substantially complimentary, in reverse, to the profile of slits 34 in part A of the tag, so that the projections may be pushed into the slits to attach part B of the tag to part A and cannot readily be withdrawn except by laterally deforming the headed projections. When attached to part A, part B of the tag is folded down along bend line 36 to dispose display portion 20 vertically in front of hook 10 for receipt of label 22. When a new label is required, part B of the tag can be removed from part A by laterally deforming the headed projections 40 to remove them from slits 34, and inserting a replacement part B with the new label. Thus, the structure avoids the necessity of having to remove and replace the tag as a whole when a new label is required. Another advantage of the structure is that the double thickness at the front edge of the tag (i.e., the section of part B of the tag adjacent projections 40 overlying the front section of part A) adds stability to the front of the tab resisting sway when, for example, a bar code on the label is being read by a code reader.

Figure 2:
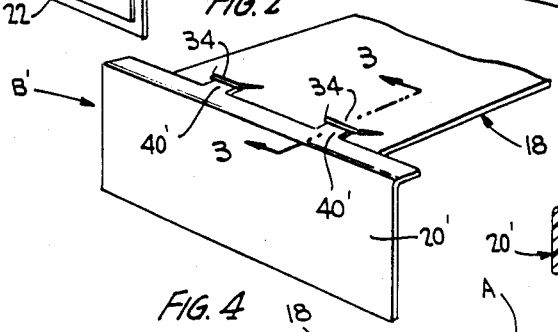
FIG. 2 is a perspective view of a front end part of a somewhat modified tag structure.
Figure 3:
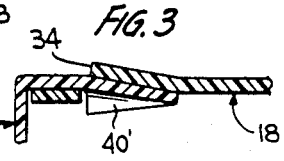
FIG. 3 is an enlarged section view on line 3—3 of FIG. 2.

As shown in FIGS. 1 and 6, the width of part B is substantially equal to the width of part A of the tag. However, for wider adhesive labels, the tag may also include a wider display portion 20' on a suitably dimensioned wider part B' as shown in FIG. 2, with projections 40' again dimensioned in conformity with slits 34.

Figure 7:
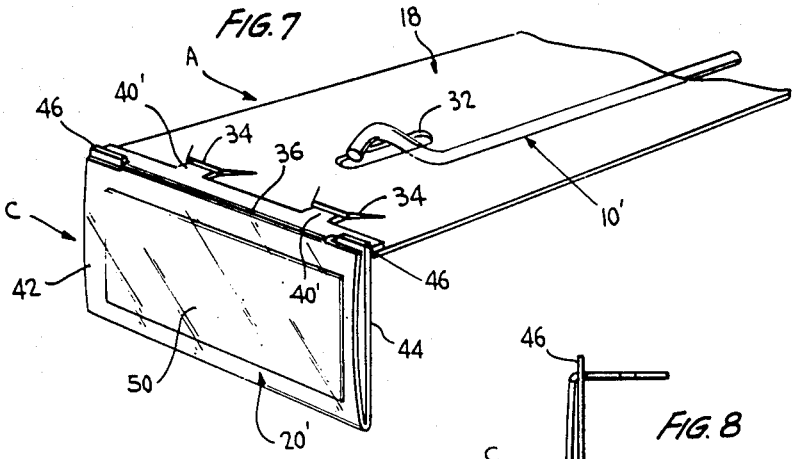
FIG. 7 is a perspective view similar to FIG. 1 of a further modified form of tag structure.
Figure 8:
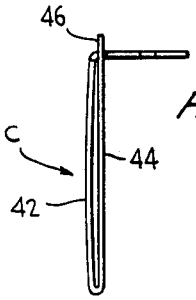
FIG. 8 is an elevational view of a display portion for the tag structure shown in FIG. 7.
Figure 9:
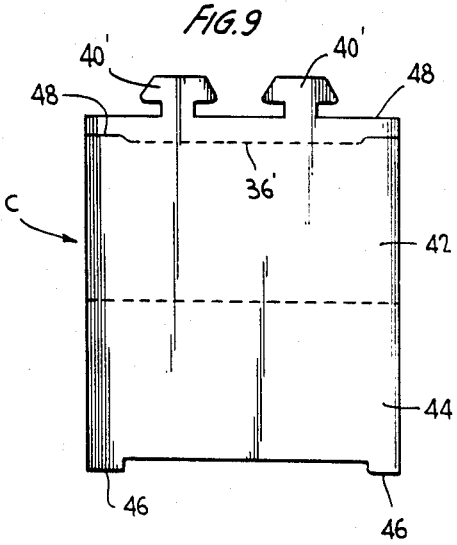
FIG. 9 is a plan view of a blank for forming the display portion.

FIGS. 7 to 9 illustrate a modified tag portion C for attachment to the front end of tag part A in place of the previously described parts B and B'. Thus, tag portion C comprises a pair of body panels 42, 44 with a central fold line, and tabs 46 at the distal end which fit into slits 48 associated with bend line 36' (conforming to bend line 36 of the tag parts B and B') so that part C can be folded to form a pocket or envelope-display display portion 20' for receipt of a non-adhesive label 50. Tag part C has spear-like headed projections 40' conforming to projections 40 of the previous embodiments which fit into the slits 34 of tag part A in the manner previously described.

Figure 10:
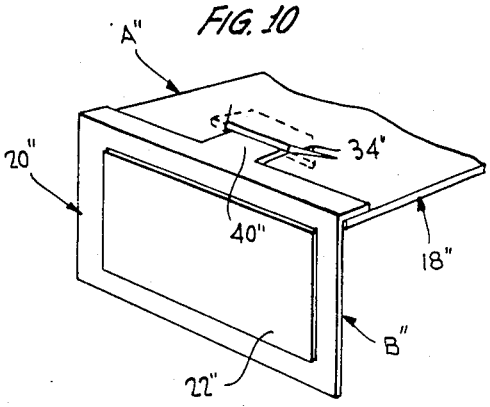
FIG. 10 is a perspective view similar to FIG. 3 showing a still further modified form of tag structure.

FIG. 10 shows still another embodiment of the invention wherein the forward end of tag part A" (conforming to part A of the previous embodiments) has only a single slit 34", and tag part B" (conforming to part B and part B' of the previous embodiments) has only a single headed spear-like projection 40" for releasable receipt therein. The single slit and single projection may be wider than each of the double slits and projections previously described and facilitates attachment and detachment of the respective tag parts.

With tag structures as shown in FIGS. 1 to 10, there may be a tendency for the display portions B, B' or B" as the case may be to "flap" upwardly relative to the respective body portion A or A' of the tag, particularly if the respective display portion is used to lift and lower the tag when removing products from the respective hook 10 or 10'. This can lead to instability or even eventual separation of the tag components. An embodiment of the invention which reduces this tendency is illustrated more particularly in FIGS. 11–13.

Figure 11:
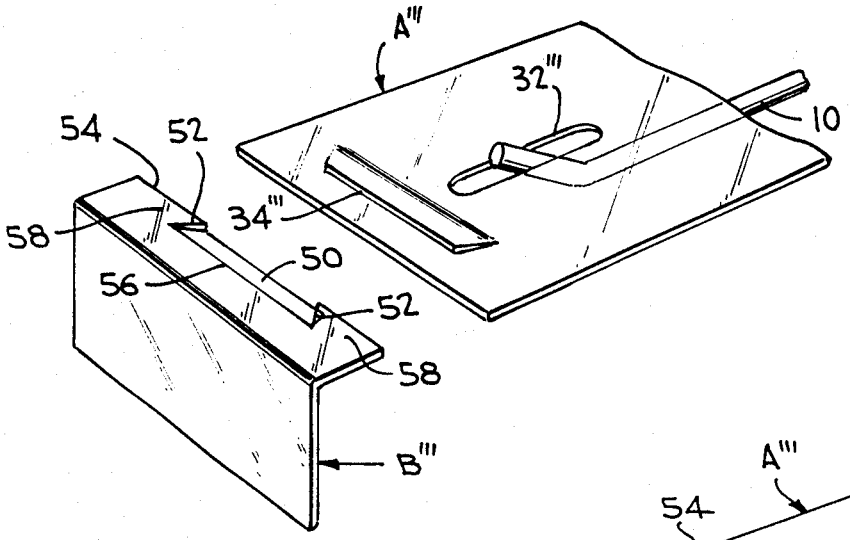
FIG. 11 is an exploded perspective view of the distal end section of another tag structure in accordance with the invention.
Figure 12:
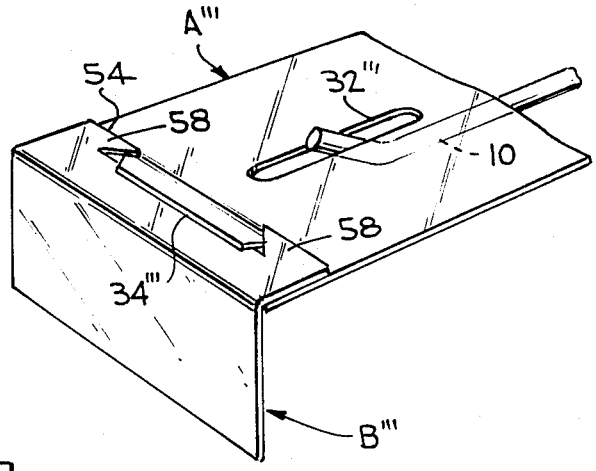
FIG. 12 is a view similar to FIG. 11 with the tag structure in assembled condition.
Figure 13:
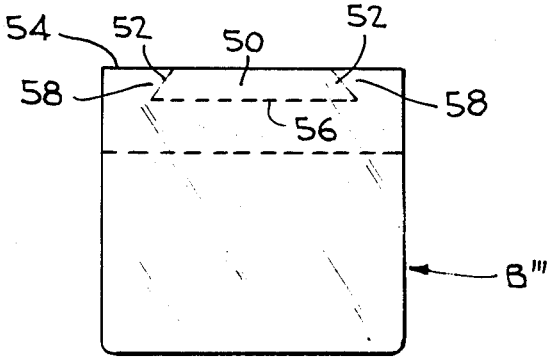
FIG. 13 is an elevational view of a blank forming a display portion of the structure shown in FIGS. 11 and 12.

In the structure shown in FIGS. 11 to 13 therefore, the tag part B''' which replaces tag parts B, B' or B" of the previous embodiments is formed with a tongue element 50 in place of the headed spear-like projections 40, 40' or 40". Tongue element 50 is actually formed in the body of part B ''' by outwardly angled slits 52 extending from edge 54 of the body and a transverse fold line 56 connecting the slits. Further, the slits define rebated projections or ears 58 on opposite sides of tongue element 50. The tongue element, as with the headed projections of the previous embodiments, is shaped to complement, in reverse, slit 34''' in the end of tag portion A'''. With this construction, when tongue element 50 is inserted into slit 34''' to connect the tag portions, the projections 58 engage against the upper surface of portion A''' beyond the transverse portion of slit 34''' and thereby form stops which preclude upward tilting or flapping of tag portion B''' relative to tag portion A''', thereby providing an even more stable structure than in the previous embodiments. It will be noted that the rebated shape of the projections 58 causes their inner rebated ends to engage over the material of tag portion A''' which defines slit 34''' thereby further enhancing the security and stability of the connection.

Figure 14:
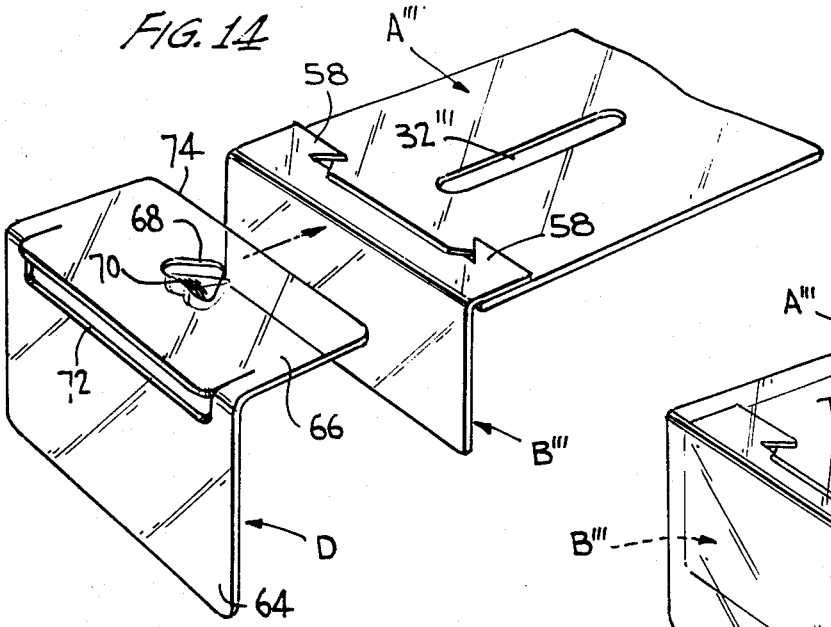
FIG. 14 is a view similar to FIG. 12 showing an auxilliary oversize display portion for use on the tag structure.
Figure 15:
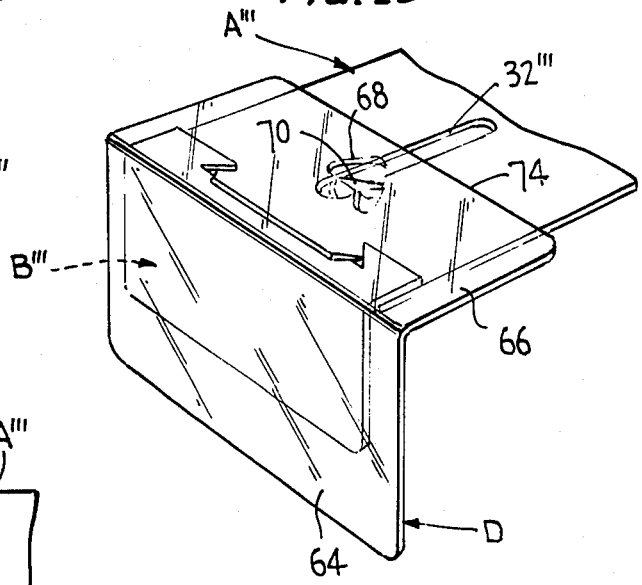
FIG. 15 is a view similar to FIG. 14 showing the oversize display portion secured to the tag structure.
Figure 16:
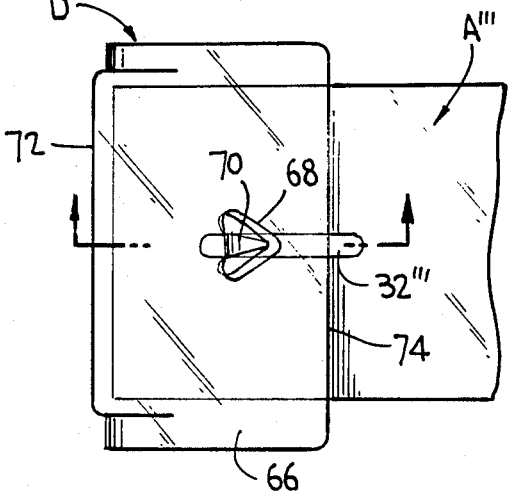
FIG. 16 is a plan view of an assembly similar to that shown in FIG. 15.

FIGS. 14 to 16 show the structure referred to in connection with FIGS. 11 to 13 with the addition of an oversize auxilliary tag display portion D which may, for example, be used as a means for providing temporary product information, such as a sale price, over the original display portion, and which may subsequently be removed when required. It is understood, however, that the auxilliary tag portion D can, if desired, be used on its own as the primary source of product information.

Figure 17:
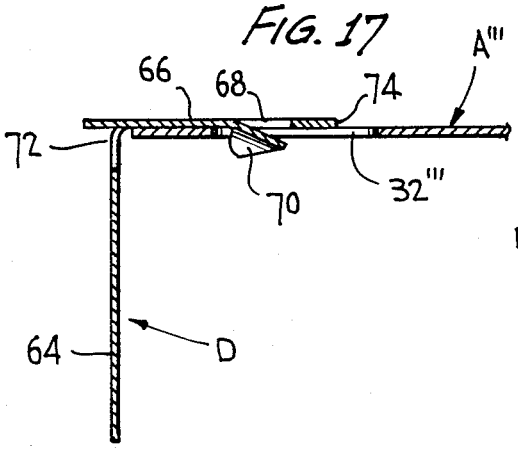
FIG. 17 is a sectional view on line 17—17 of FIG. 16.
Figure 18:
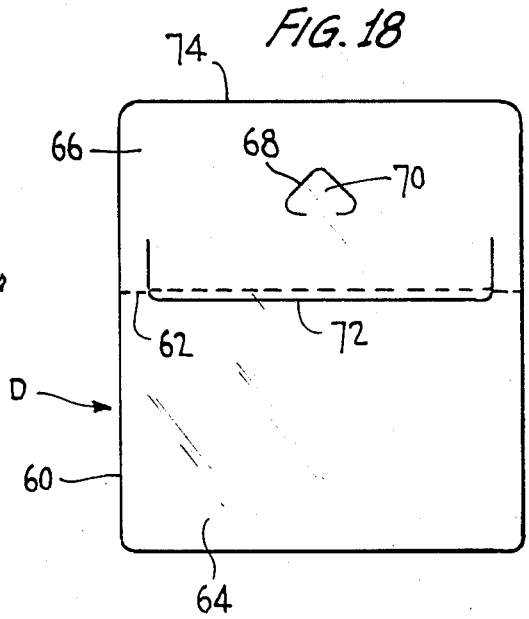
FIG. 18 is an elevational view of a blank forming the oversize display portion.

Display portion D (see FIG. 18) is formed from a die-cut rectangular plastic blank 60 with a transverse fold line 62 defining a display panel 64 or product information, and an attachment panel 66. The attachment panel is provided with a substantially centrally located slit 68 defining a substantially heart-shaped depressable head 70. The dimensions and configurations of display portion D are such that head 70 when laterally flexed, can be worked into slot 32''' of tag portion A''' while gripping the edges of panel 66 so as to attach portion D to the structure over tag portion B'''. Head 70 can be slid along slot 32''' to the required position wherein panel 64, which has been folded about line 62, hangs down in front of tag part B'''. It will be understood that display portion D can be used on any tag structure having a slot conforming to illustrated slot 32'''. FIGS. 16 and 17 show display portion D used on its own in conjunction with tag part A''', i.e. without tag part B'''. Further, as seen in FIG. 18, tag portion D is formed with a channel-shaped cut-out 72. This enables portion D to be used per se as a flag in a standard form of price channel with the upper part of portion D between edge 74 and cut-out 72 being flexed into the price channel and with panel 64 depending from the price channel for the display of product information.

While only preferred embodiments of the invention have been described herein in detail, the invention is not limited thereby and modifications can be made within the scope of the attached claims.

I claim:

1. In a product identification and information tag of sheet material for use in conjuction with an elongate hook projecting substantially horizontally from a support surface for suspending products thereon, the tag comprising a mounting portion for releasably attaching the tag to the hook adjacent said surface, and elongate intermediate portion extending from the mounting portion for overlying the hook and a display product information and/or identification data in a substantially vertically extending plane forwardly of the hook, the improvement comprosing releasable attachment means between the display portion and the intermediate portion of the tag permitting removal and replacement of the display portion, wherein the intermediate portion is formed on a first part of the tag, and the display portion is formed on a separate second part of the tag, the second part of the tag also including an attachment portion and a transverse bend line defining a boundary of the display portion and the attachment portion, and wherein the attachment means comprises at least one male connector element associated with the attachment portion of the second part and a corresponding female connector element adjacent a forward edge of the intermediate portion of the tag, the spacing of said bend line from said male connector element being related to the spacing of said female connector element from said forward edge of the intermediate portion for folding the display portion along said bend line forwardly of the intermediate portion when the respective parts of the tag are mutually attached and wherein the attachment portion of the second tag part further includes projection means adjacent the male connector element for engaging and upper surface of the intermediate portion when the male connector element is engaged in the female connector element and thereby providing a stop precluding upward tilting of the second tag part relative to the intermediate portion.

2. The invention of claim 1 wherein the male connector element comprises a tongue element at one edge of the attachment portion of the second tag part, and the female connector element comprises a slit in the intermediate portion of the tag having a profile substantially corresponding to the profile of the tongue element in reverse.

3. The invention of claim 2 wherein the tongue element is formed by a pair of outwardly inclined slits extending inwardly from one edge of the attachment portion, the slits further defining rebated ears on opposite sides of the tongue element forming the projection means.

4. The invention of claim 1 wherein the male connector element comprises a depressable head in the attachment portion of the second tag part, and the female connector element comprises an elongate longitudinally extending slot in the intermediate portion of the tag for receiving the distal end of the hook, the depressable head having a greater width than the slot whereby the head is worked into the slot by suitable manipulation of the second tag part.

5. The invention of claim 4 wherein the depressable head is formed by a substantially heart-shaped slit in the attachment portion of the second tag part.

6. The invention of claim 4 wherein the first part of the tag has an existing display portion depending at its distal end, and the second part of the tag forms an auxiliary display portion over the existing display portion.

7. The invention of claim 6 wherein the existing display portion is formed on a third detachable part of the tag.

8. A substantially rectangular blank of plastic sheet material for use as a display portion attachable to the distal end of a product information and display tag structure having an elongate portion extending over a product suspension hook, the blank including a display panel and an attachment panel separated by a transverse bend line extending across the blank, and a pair of outwardly inclined slits extending from a free edge of the attachment panel which is parallel said bend line, the slits defining a tongue element therebetween for receipt in a corresponding slit in the elongate portion of the tag and rebated ears on opposite sides of the tongue element for engaging an upper surface of the elongate portion and precluding upward tilting of the display portion relative the elongate portion.

9. The invention of claim 8 wherein the blank includes a further bend line connecting the slits and disposed in parallel with said transverse bend line.

10. A substantially rectangular blank of plastic sheet material for use as a display portion attachable to the distal end of a product information and display tag structure having an elongate portion extending over a product suspension hook, the blank including a display panel and an attachment panel separated by a transverse bend line extending across the blank, and a slit defining a depressable head located substantially centrally of the attachment panel for working into an elongate slot in the elongate portion of the tag for attaching the blank thereto.

11. The invention of claim 10 wherein the head is substantially heart-shaped.

12. The invention of claim 10 wherein the blank has a channel-shaped cut-out with an elongate base portion parallel and adjacent the transverse bend line and perpendicular end portions extending from the base portion toward the depressable head, the cut-out providing a portion of the blank including the depressable head for flexing into a price channel with the display panel of the blank projecting below the price channel to form a price channel flag.

* * * * *